United States Patent [19]

Sleveland

[11] Patent Number: 4,755,913

[45] Date of Patent: Jul. 5, 1988

[54] LIGHT EMITTING DIODE ASSEMBLY INSTALLED ON THE BACK OF AN ELECTRICAL SWITCH WALL PLATE TO INDICATE, IN THE DARK, THE LOCATION OF THE SWITCH, OR TO INDICATE AT ANY TIME AN ELECTRICAL CIRCUIT IS CARRYING CURRENT

[76] Inventor: Kenley R. Sleveland, 426 5th St. N.E., Puyallup, Wash. 98372

[21] Appl. No.: 118,457

[22] Filed: Nov. 9, 1987

[51] Int. Cl.[4] ..... F21V 33/00

[52] U.S. Cl. ..... 362/95; 362/800; 200/310

[58] Field of Search ..... 362/95, 800; 200/310, 200/312, 317; 315/129, 133

[56] References Cited

U.S. PATENT DOCUMENTS

| | | | |
|---|---|---|---|
| 2,580,056 | 12/1951 | Wheeler, Jr. | 362/95 |
| 2,603,733 | 7/1952 | Pastrick | 362/95 X |
| 4,255,780 | 3/1981 | Sakellaris | 362/95 X |
| 4,514,789 | 4/1985 | Jester | 362/95 |

*Primary Examiner*—Stephen F. Husar
*Attorney, Agent, or Firm*—Roy E. Mattern, Jr.

[57] ABSTRACT

A light emitting diode assembly is preliminarily installed on the back of an otherwise essentially standard switch wall plate of a standard electrical switch assembly, and thereafter connected optionally, either to indicate the location in the dark, of a turned off electrical switch assembly, by using a green light emiting diode connected across the terminals of the electrical switch assembly, or to indicate if the circuit is energized to carry current, upon the turning on of an electrical switch assembly, by using a red light emitting diode connected in the load circuit. A resistor and a direct current diode are utilized to modify the voltage and current for the light emitting diode. A plastic material is used to hold in place a substantial portion of the light emitting diode assembly on the back of the switch wall plate, while portions of the light emitting diode extend through a hole in the switch wall plate, to be observed throughout the space to be lighted.

8 Claims, 3 Drawing Sheets

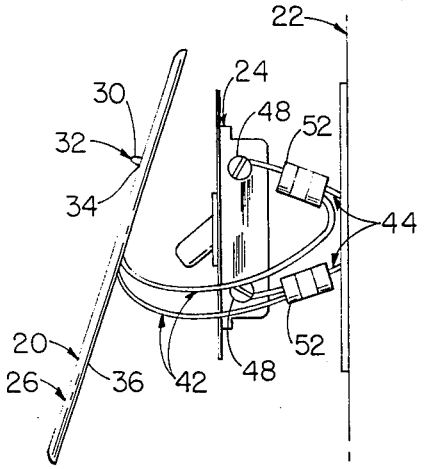
FIG. 4
FIG. 5
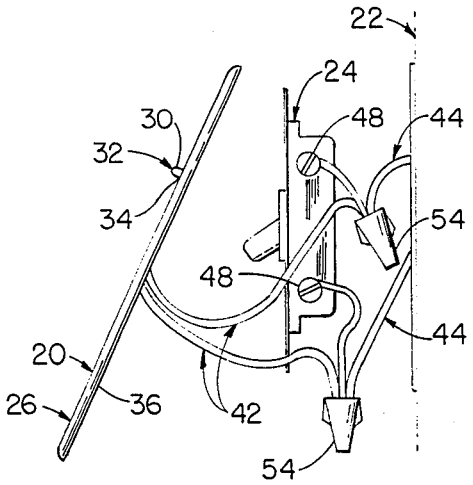
FIG. 6
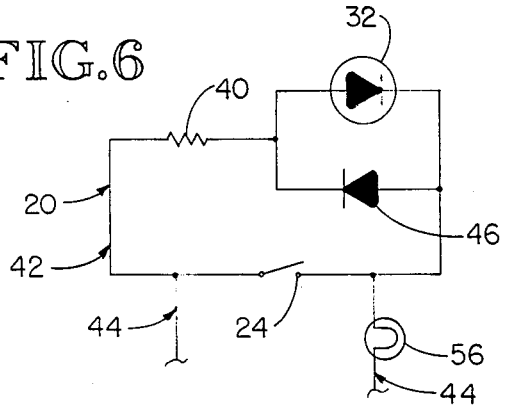
FIG. 7
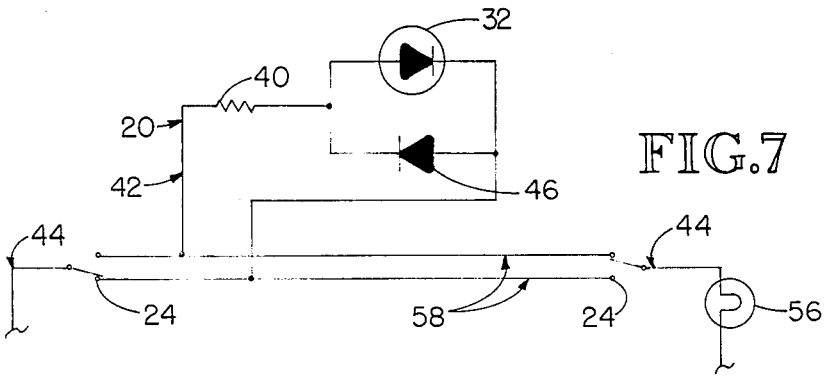

FIG.8
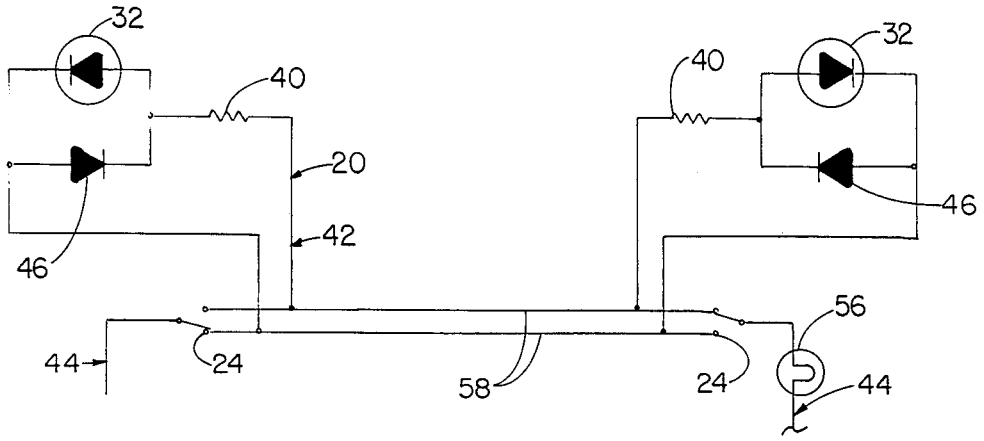
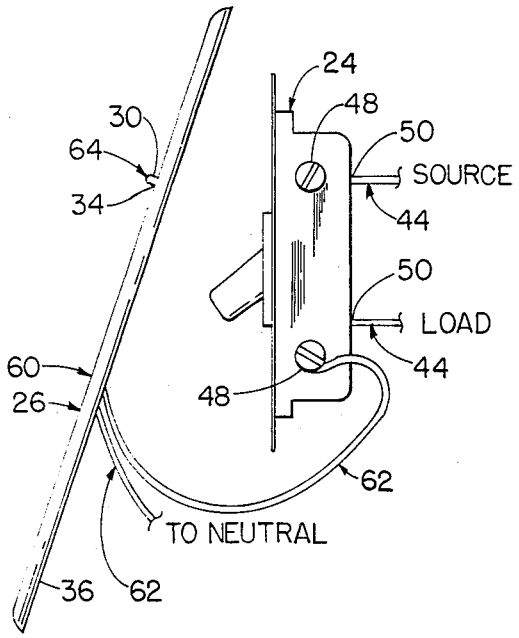
FIG.9
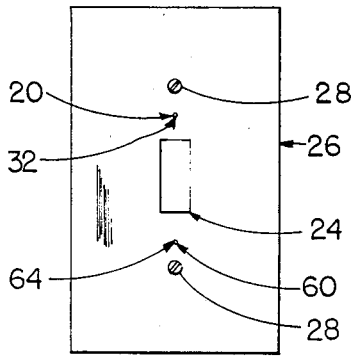
FIG.10

LIGHT EMITTING DIODE ASSEMBLY INSTALLED ON THE BACK OF AN ELECTRICAL SWITCH WALL PLATE TO INDICATE, IN THE DARK, THE LOCATION OF THE SWITCH, OR TO INDICATE AT ANY TIME AN ELECTRICAL CIRCUIT IS CARRYING CURRENT

BACKGROUND

Low electrical energy consuming location lights, located by electrical switches, have been provided previously.

Thomas L. Wheeler, Jr., in his U.S. Pat. No. 2,580,056 of 1951, disclosed an electrical light wall switch plate having a specially designed switch wall plate inclusive of an outwardly bulged portion to receive a resistor and a neon bulb. The light from the neon bulb indicated the whereabouts of the switch and also provided a reduced degree of illumination for a person to distinguish objects or obstacles in the room before the main room light was turned on.

Michael A. Pastrick in his U.S. Pat. No. 2,603,733 of 1952, illustrated and described his electrical switch, especially made to include a glow tube in the finger manipulated handle of the special electrical switch, which in turn had special contactors.

Michael H. Jester in his U.S. Pat. No. 4,514,789 of 1985, disclosed his illuminated light switch with a light emitting diode and an oscillator circuit, all supplied with battery energy. The light switch plate was specially made to receive the complete assembly of the illuminated light switch components, which during use made it possible for a person entering a dark room to quickly locate the light switch.

Peter C. Sakellaris in his U.S. Pat. No. 4,255,780 of 1981, disclosed his illumination assembly for use with electrical terminal units, centering on a special threaded illumination display means used in place of a holding screw, in turn receiving light via an optical fiber means, in turn receiving light from a neon bulb, receiving its electrical energy from the overall main circuit energy of a building.

Although these inventors have previously provided products to serve the need for finding an electrical switch in a dark room, there remained a need for a low energy consuming switch location light, deriving its electrical energy, as modified, from the overall main circuit energy, and arranged in an assembly secured for the most part to the back of a substantially standard electrical switch plate for the convenience of manufacturing, distribution, and installation.

SUMMARY

To fulfill the need of having a light switch easily observed and found in a dark room, and/or to indicate that a circuit turned on, as observed by a switch position, is carrying current, light emitting diode assemblies, using minimal electrical energy, are installed initially and essentially on the back of a standard electrical switch wall plate, by using a securing plastic, which also positions the light emitting diode in a countersunk hole formed in this wall plate. As so initially arranged and secured, the light emitting diode assemblies are then distributed and marketed to electrical contractors or directly to owners of buildings for their convenient installation.

Preferably a green light emitting diode is used to indicate the location of an electrical switch, and for this purpose, the light emitting diode assembly is connected across the terminals of the standard electrical light switch assembly.

Preferably a red light emitting diode is used to indicate, when an electrical switch is turned on, that current is flowing in the circuit, and for this purpose, the light emitting diode assembly is connected in the load wire.

Also both the green and red light emitting diodes, with their respective assemblies, are located at the same electrical switch assembly to provide their respective signals.

These light emitting diode assemblies are also installed at double electrical switch locations, and multiple way electrical switch locations.

The source components are essentially all readily available at comparative, reasonable, low costs, and they are assembled conveniently at a comparative, reasonable, low cost.

When the green light emitting diode is used as a location identifying light, while serving as a pilot light and not as a night light, the light does not interfere with persons trying to sleep or to relax. The pleasant green glow indicates the electrical light switch is here and the lighting circuit power is available. The solid state circuitry and the light emitting diode do not change the usefulness nor the appearance of the essentially standard style light switch plate. If the light bulb used in lighting the area is burned out, the green light emitting diode will not be on, indicating that the light bulb needs replacing.

DRAWINGS

The light emitting diode assemblies serving their respective observable signals of either an electrical switch location, via a green light, or an energized circuit, via a red light, both observations being made at the switch plate of an electrical switch assembly, are illustrated in the accompanying drawings, wherein:

FIG. 1 is a perspective view of an electrical switch plate mounted on a wall indicating the location of the partially protruding light emitting diode just above the electrical switch actuator, positioned in the hole, which is the only modification of the otherwise standard electrical switch plate;

FIG. 2 is an elevational view of the back of the electrical switch plate illustrating the mounting of the light emitting diode assembly to this back by a covering of a securing plastic, indicated by the dotted lines, with the light emitting diode, the direct current forming diode, and the voltage and current reducing resistor, with some portions of the circuitry, all being shown, as included within the covering securing plastic, thereby making light emitting diode assemblies conveniently handled, distributed, stored, packaged, and installed;

FIG. 4 is a partial side view, similar to FIG. 3 of the connected green light emitting diode assembly, showing, however, how self stripping electrical connectors are used, when an electrical switch assembly does not have snap in terminal receivers, having only side screw terminals;

FIG. 5 is a partial side view, similar to FIGS. 3 and 4 of the connected green light emitting diode assembly, illustrating how cone shaped wing wire end connectors are used, when an electrical switch assembly does not have snap in terminal receivers, having only side screw terminals;

FIG. 6 is a schematic circuit diagram of the installed green light emitting diode assembly connected with respect to a light switch and light bulb used to illuminate an area, and with the main circuitry, in reference to providing a green location light at the sole electrical switch serving at least one light bulb;

FIG. 7 is a schematic circuit diagram of the installed green light emitting diode assembly connected between traveller circuit wires of a lighting circuit having at least two electrical switches and at least one light bulb;

FIG. 8 is a schematic circuit diagram of the two installed green light emitting diode assemblies both connected between traveller circuit wires of a lighting circuit having at least two electrical switches and at least one light bulb;

FIG. 9 is a partial side view, illustrating how the red light emitting diode assembly, which shows a turned on circuit is carrying current, is connected in a load or neutral circuit wire; and FIG. 10 is a front view of an electrical switch plate, changed to provide a hole to receive both a green and a red light emitting diode.

DESCRIPTION OF THE PREFERRED EMBODIMENTS

Figure 1:
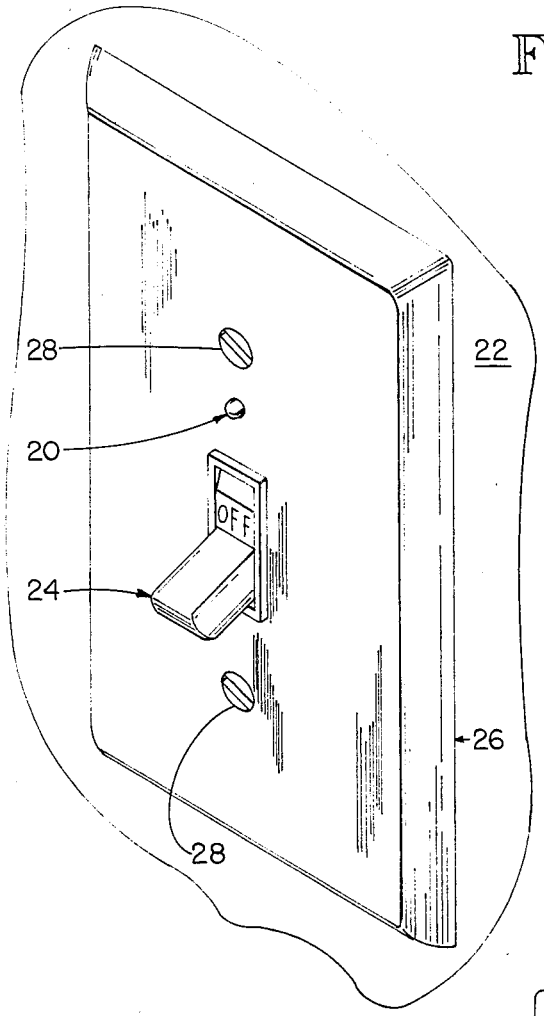

Green Light Emitting Diode Assembly to Indicate the Location of an Electrical Light Switch In FIGS. 1 through 8, a green light emitting diode assembly 20 is illustrated, which is observed in determining where a light switch is located in a dark area. As shown in FIG. 1, the installed light emitting diode assembly 20, at a wall 22 location, appears almost identical to a standard electrical light switch assembly 24.

Its plate 26 is held in place by fasteners 28. However, there is the addition of only a protruding partial portion 30 of a light emitting diode 32, positioned in a countersunk hole 34.

Figure 2:
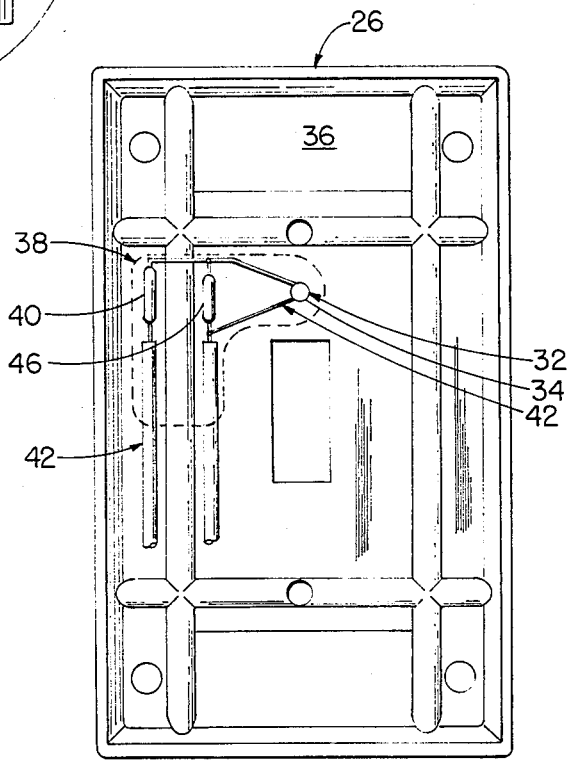

As shown in FIG. 2, most of the green light emitting diode assembly 20, at the time of manufacture, is secured to the back 36 of the switch plate 26 by using a covering and securing plastic 38, indicated by the boundary of dotted lines. The light emitting diode 32 is held against a shoulder, not shown, of the countersunk hole 34 by this plastic 38. Essentially, except for packaging, the green light emitting diode assembly 20 is completed, as illustrated in FIG. 2.

The resistor 40, which is used in the circuitry 42 of the green light emitting diode assembly 20, reduces the voltage and current of the main circuitry 44. Thereafter, the diode 46 eliminates one phase of the electrical energy to be supplied to the green light emitting diode assembly 20. Therefore, the green light emitting diode 32 thereof, is essentially receiving a low voltage direct current to create the observable green pilot light, indicating the location of the light switch 24.

Figure 3:
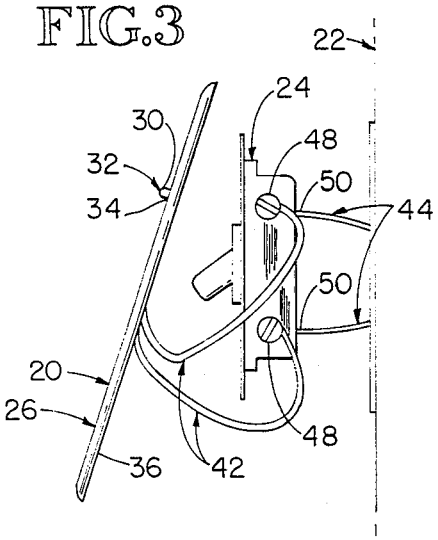
FIG. 3 is a partial side view, illustrating how the green light emitting diode assembly, which shows where the light switch is located, is connected across the terminals of an electrical light switch assembly, which also has previously received the snap in ends of the main lighting circuit.

In FIG. 3, the green light emitting diode assembly 20 is shown connected to the standard switch assembly 24. The threaded and capped terminals 48 of this switch assembly 24, receive the circuitry 20 of the green light emitting diode assembly 20, and the main circuitry 44 is received by the snap in connectors 50 of this standard switch assembly 24.

In FIG. 4, which is quite similar to FIG. 3, the green light emitting diode assembly 20 is shown connected to another standard switch assembly 24, which, however, does not have snap in connectors 50 to receive the main circuitry 44. Instead the threaded and capped terminals 48, receive the main circuitry 44. Therefore, in observing the best electrical practices, the circuitry 42 and circuitry 44 are interconnected by using selfstripping electrical connectors 52.

In FIG. 5, which is also quite similar to FIGS. 3 and 4, the green light emitting diode assembly 20 is shown connected to a standard switch assembly 24, which also does not have snap in connectors 50 to receive the main circuitry 44. Therefore the threaded and capped terminals 48 receive the main circuitry 44. Consequently, the circuitry 42 of the green light emitting diode assembly 20, and the main circuitry 44, are interconnected by using cone shaped wing wire nuts 54.

Schematic Electrical Diagrams

Schematic electrical diagrams are presented in FIGS. 6, 7 and 8, to illustrate how the green light emitting diode assembly 20 is connected, via its circuitry 42, to the main circuitry 44, supplying the electrical lighting energy.

A basic installation of a green light emitting diode assembly 20 with one standard switch assembly 24 and one light bulb 56, used in lighting an area, is shown in FIG. 6, indicating the arrangement of the reducing resistor 40, the direct current making diode 46, the green light emitting diode 32, the standard switch assembly 24 and the light bulb 56, used in lighting the area.

A basic installation of a green light emitting diode switch assembly 20 with two standard switch assemblies 24 and one light bulb 56 is shown in FIG. 7, indicating the components, as described in discussing FIG. 6. The assembly 20 is connected across the traveller circuitry 58 of the two switch assemblies 24.

A basic installation of two green light emitting diode switch assemblies 20, with two standard switch assemblies 24 and one light bulb 56 is shown in FIG. 8, indicating the components, as described in discussing FIG. 6. Both of the assemblies 20 are connected across the traveller circuitry 58 of the two switch assemblies 24.

In all FIGS. 6, 7, and 8, more light bulbs 56 connected in a lighting circuitry serving a designated area could be serviced by light switch assemblies 24, to be located in the dark area, and found by observing the green light of the green light emitting diode assembly 20.

Red Light Emitting Diode Assembly to Indicate That Electrical Current is Flowing When an Electrical Standard Switch Assembly Has Been Turned On In FIG. 9, the installation of a red light emitting diode assembly 60 is illustrated as its circuitry 62 connected to the load and neutral wires of the main power circuitry 44. Therefore, when the standard switch assembly 24 is closed, the red light emitting diode 64 will indicate that current is flowing in the main power circuitry 62, which may be sending electrical energy to an important apparatus, such as a water pump, not shown.

Utilization of Both Green and Red Light Emitting Diode Assemblies at One Standard Switch Assembly As indicated in FIG. 10, both green and red lights may be alternately observed at one standard switch assembly 24 location, as they protrude through a switch plate 26. The green light emitting diode assembly 20 will be useful in finding the switch in the dark area, and the red light emitting diode assembly 60, will be useful in assuring the current is flowing, when the switch is in the on position. Both of these assemblies, 20 and 60, are conveniently secured in part with the plastic 38 on the back 36 of the electrical switch plate 26.

Information Regarding Some of the Specific Components

The light emitting diodes 32, 64 used, are referred to as diffused solid state lamps of high efficiency. They are sized to a maximum of 0.125 inches in diameter and 0.185 inches long through the shoulder, thereafter extending an additional 1.0 inch for the leads. The selected green light has a minimum luminous intensity at 25° C. of 6.0 and a typical luminous intensity of 10.0, while drawing 20 milliamperes. The selected red light has a minimum luminous intensity of 3.0 and a typical luminous intensity of 4.0, while drawing 10 milliamperes. The light emitting diodes preferably protrude 0.25 inches out from the switch plate.

The resistor used in reference to these selected light emitting diodes is designated as 47K ohm one half watt resistor.

The diode selected to pass only the one half of the wave of alternating current on to light emitting diode as, in effect, a direct current is designated as 1N4001 diode.

As a combination this diode and resistor are called a half wave rectifier.

The resulting voltages across this diode and the light emitting diode referred to as an L.E.D., alternates between 0.6 to 1.2 volts.

A plastic or epoxy is used to secure many portions of the light emitting diode assembly 20, either by a potting or molding process. A selected epoxy is a two part epoxy, designated as "Scotch-Weld Structural Adhesive 2158 B/A.

The operating cost is minimal, with the voltage in the range of 0.6 to 1.2 volts and the direct current peaking at 3.61 milliamperes for operation of the light emitting diode, and with the power dissipation through the resistor of 0.31 watts.

The entire light emitting diode assemblies 20 and 60 obtain their energy via the 120 volt standard voltage circuits, and thereafter modify this energy to the low levels of voltage and current. In so doing these excellent informative observed green and red light emitting diodes fulfill their respective needed operational needed requirements.

What is claimed is:

1. A light emitting diode assembly installed on the back of an otherwise standard switch wall plate of a standard electrical switch assembly, also having circuit terminals and a finger actuated on and off means, to indicate the location, in the dark, of the turned off electrical switch assembly, by using a green light emitting diode, and/or to indicate if the circuit is energized upon the turning on of the electrical switch assembly, by using a red light emitting diode, comprising:

(a) a standard switch wall plate for fitting over finger activated on and off means of a standard electrical switch assembly, having at least one additional hole formed to receive a light emitting diode;

(b) additional circuitry adapted to be installed in the clearances available about an installed standard electrical switch assembly, having:

(i) at least one resistor to reduce the main line voltage and current to lower levels to operate a light emitting diode;

(ii) at least one diode to pass on only a half wave of the reduced main line voltage and current, thereby producing a low direct current at low voltage to operate a light emitting diode;

(iii) at least one light emitting diode to receive the low direct current at low voltage derived from the reduced main line voltage and current;

(iv) circuit wires to extend and to be extended between: the main line voltage and current; the resistor; the diode; and the standard electrical switch assembly; and (v) connecting means to join the circuit wires to: the main line voltage and current; the resistor; the diode; and the standard electrical switch assembly, via the circuit terminals thereof;

whereby, when a green light emitting diode is indicating in the dark the location of an electrical switch assembly in an off position, some of the connecting means are connected across the open circuit terminals thereof, and whereby, when a red light emitting diode is indicating at any time the utilization of electrical power, via the electrical switch assembly in an on position, some of the connecting means are connected into a main circuit wire normally carrying current, when the electrical switch assembly is in an on position and there is a source of electrical energy being utilized.

2. A light emitting diode assembly, as claimed in claim 1, wherein the standard switch wall plate has a total of two additional holes formed to receive both green and red light emitting diodes.

3. A light emitting diode assembly, as claimed in claim 1, wherein the at least one additional hole formed to receive the light emitting diode is countersunk to position the light emitting diode, so that a sufficient portion thereof extends through the standard switch wall plate, to produce a light that is observable from any direction in the dark area, which subsequently will be lighted, when the standard electrical switch assembly is operated, as the finger actuated on and off means is moved to the on position, and then the light is turned off which had been observed at the extending portions of the light emitting diode.

4. A light emitting diode assembly, as claimed in claim 1, wherein the additional circuitry in part is surrounded by a plastic material which adheres both to portions of the additional circuitry and to the standard switch wall plate, leaving only sufficient portions of this additional circuitry free for subsequent connections to the main line voltage and current.

5. A light emitting diode assembly installed on the back of an otherwise standard switch wall plate of a standard electrical switch assembly, also having circuit terminals and a finger actuated on and off means, to indicate the location, in the dark, of the turned off electrical switch assembly, by using a green light emitting diode, comprising:

(a) a standard switch wall plate for fitting over finger activated on and off means of a standard electrical switch assembly, having one additional hole formed to receive a green light emitting diode;

(b) additional circuitry adapted to be installed in the clearances available about an installed standard electrical switch assembly, having:

(i) a resistor to reduce the main line voltage and current to lower levels to operate a light emitting diode;

(ii) a diode to pass on only a half wave of the reduced main line voltage and current, thereby producing a low direct current at low voltage to operate a light emitting diode;

(iii) a green light emitting diode to receive the low direct current at low voltage derived from the reduced main line voltage and current;

(iv) circuit wires to extend and to be extended between: the main line voltage and current; and resistor; the diode; and the standard electrical switch assembly; and (v) connecting means to join the circuit wires to: the main line voltage and current; the resistor; the diode; and the standard electrical switch assembly, via the circuit terminals thereof;

whereby, when a green light emitting diode is indicating in the dark the location of an electrical switch assembly in an off position, some of the connecting means are connected across the open circuit terminals thereof.

6. A light emitting diode assembly as claimed in claim 5, wherein if standard electrical switch assembly is one of two or more standard electrical switch assemblies controlling a single light source used to illuminate a space, the additional circuitry and the connecting means are adapted to be connected across traveller wires of the circuitry serving to carry electrical energy to this single light source.

7. A light emitting diode assembly, as claimed in claim 6, is supplemented by one or more green light emitting diode assemblies, so there will be a green light emitting diode connected at each standard electrical switch assembly across the traveller wires of the circuitry serving to carry electrical energy to this single light source.

8. A light emitting diode assembly installed on the back of an otherwise standard switch wall plate of a standard electrical switch assembly, also having circuit terminals and a finger actuated on and off means, to indicate if the circuit is energized upon turning on of the electrical switch assembly, by using a red light emitting diode, comprising:

(a) a standard switch wall plate for fitting over finger activated on and off means of a standard electrical switch assembly, having one additional hole formed to receive a red light emitting diode;

(b) additional circuitry adapted to be installed in the clearances available about an installed standard electrical switch assembly, having:

(i) a resistor to reduce the main line voltage and current to lower levels to operate a light emitting diode;

(ii) a diode to pass on only a half wave of the reduced main line voltage and current, thereby producing a low direct current at low voltage to operate a light emitting diode;

(iii) a red light emitting diode to receive the low direct current at low voltage derived from the reduced main line voltage and current;

(iv) circuit wires to extend and to be extended between: the main line voltage and current; the resistor; the diode; and the standard electrical switch assembly; and (v) connecting means to join the circuit wires to: the main line voltage and current; the resistor; the diode; and the standard electrical switch assembly, via the circuit terminals thereof;

whereby, when a red light emitting diode is indicating at any time the utilization of electrical power, via the electrical switch assembly in an on position, some of the connecting means are connected into a main circuit wire normally carrying current, when the electrical switch assembly is in an on position and there is a source of electrical energy being utilized.

* * * * *